United States Patent [19]

Von Holdt

[11] 4,420,093

[45] Dec. 13, 1983

[54] MOLDED BUCKET AND LID HAVING HIGH STACK STRENGTH

[76] Inventor: John W. Von Holdt, 7430 N. Croname Rd., Niles, Ill. 60648

[21] Appl. No.: 356,496

[22] Filed: Mar. 9, 1982

Related U.S. Application Data

[63] Continuation-in-part of Ser. No. 319,933, Nov. 10, 1981, and Ser. No. 329,258, Dec. 10, 1981, Pat. No. 4,380,305.

[51] Int. Cl.[3] ..... B65D 41/16; B65D 41/18

[52] U.S. Cl. ..... 220/306; 206/508; 206/509; 150/55

[58] Field of Search ..... 220/306, 307; 206/508, 206/509; 150/0.5

[56] References Cited

U.S. PATENT DOCUMENTS 4,256,240 3/1981 Woinarski ..... 220/306

4,308,970 1/1982 Von Holdt ..... 220/306

*Primary Examiner*—George T. Hall

*Attorney, Agent, or Firm*—Charles F. Pigott, Jr.

[57] ABSTRACT

A molded bucket comprises a bucket lip defining an enlarged annular projection at the mouth of the bucket; an inwardly positioned annular shelf facing the mouth adjacent the lip; and an outwardly positioned annular flange joined to said bucket adjacent the annular shelf to provide extra hoop strength to the area of the shelf. The lid for the bucket defines an annular recess receiving the annular projection of the bucket lip in locking relation and an annular straight wall which extends radially inwardly from the recess, at an angle of essentially 20° to 60° from the axis of the bucket, with the inner edge extending outwardly toward the mouth relative to the outer edge. The angled annular straight wall serves as a cantilever beam to transmit stacking force to the annular shelf, so that the bucket does not distort or collapse under conditions of high stacking, the bucket being preferably a tapered bucket.

9 Claims, 2 Drawing Figures

MOLDED BUCKET AND LID HAVING HIGH STACK STRENGTH

CROSS-REFERENCE TO RELATED APPLICATIONS

This application is a continuation-in-part of U.S. Application Ser. No. 319,933 filed Nov. 10, 1981 and U.S. Application Ser. No. 329,258 filed Dec. 10, 1981, now U.S. Pat. No. 4,380,305.

BACKGROUND OF THE INVENTION

In U.S. Pat. No. 4,210,258 a seal for plastic buckets and cans is disclosed in which the lip of the bucket and the lid are of a design that permits easy opening, while at the same time avoiding accidental "pop-off" of the lid upon dropping of the bucket, despite the inherently greater flexibility of plastic over the conventional metal cans.

In accordance with this invention, a plastic bucket is provided which can exhibit good resistance to accidental "pop-off" of the lid, while being readily removable by the user, and also where the bucket exhibits exceptional stacking strength so that even though the bucket is made of plastic material, large, heavy, filled buckets of the design of this invention can be stacked six or eight high without distortion or collapse of the lowest bucket in the stack.

DESCRIPTION OF THE INVENTION

In accordance with this invention, a molded bucket comprises a bucket lip defining an enlarged, annular projection at the mouth of the bucket, an inwardly positioned annular shelf facing the mouth adjacent the lip, and an outwardly positioned annular flange joined to the bucket adjacent the annular shelf, to provide extra hoop strength to the area of the annular shelf. The annular flange may particularly be curved in its cross section to define a flange section which is in longitudinal relation to the bucket wall, so that the flange will not project outwardly in an inconvenient manner.

The lid which may be attached to the bucket may define in one piece a peripheral, annular recess, receiving the annular projection in locking relation. An annular straight wall extends radially inwardly from the vicinity of the recess at an angle of essentially 20° to 60° from the axis of the bucket, with the annular, straight wall being positioned with its outer edge adjacent the annular recess, and also positioned to abut the annular shaft so as to be supported by the shelf. The inner edge of the annular straight wall extends outwardly toward the mouth, relative to the outer edge.

As the result of this, the bucket and lid exhibit high stacking strength when the weight of another bucket carried on the lid is transmitted by the annular, straight wall to the annular shelf, being supported by the reinforced area, in terms of hoop strength, of the annular shelf. Particularly, tapered buckets are desirably used in conjunction with this invention so that the bottom of the bucket has less diameter than the lip, being particularly of a diameter of no more than the inner edge of the annular straight wall.

Radial vanes may also be provided to stiffen the annular straight wall, which may act as a sort of annular cantilever beam to transmit the force to the reinforced bucket mouth as described above.

Also, an annular, upstanding flange may be provided on the outer side of the lid at the inner edge of the annular straight wall to receive the end of the tapered bucket therein for proper positioning of the bucket.

Such a structure has been shown to exhibit very high stacking strength, while having many other good characteristics for a bucket capable of reliably sealing its contents even when dropped, but at the same time being easily openable.

DESCRIPTION OF SPECIFIC EMBODIMENTS

Figure 1:
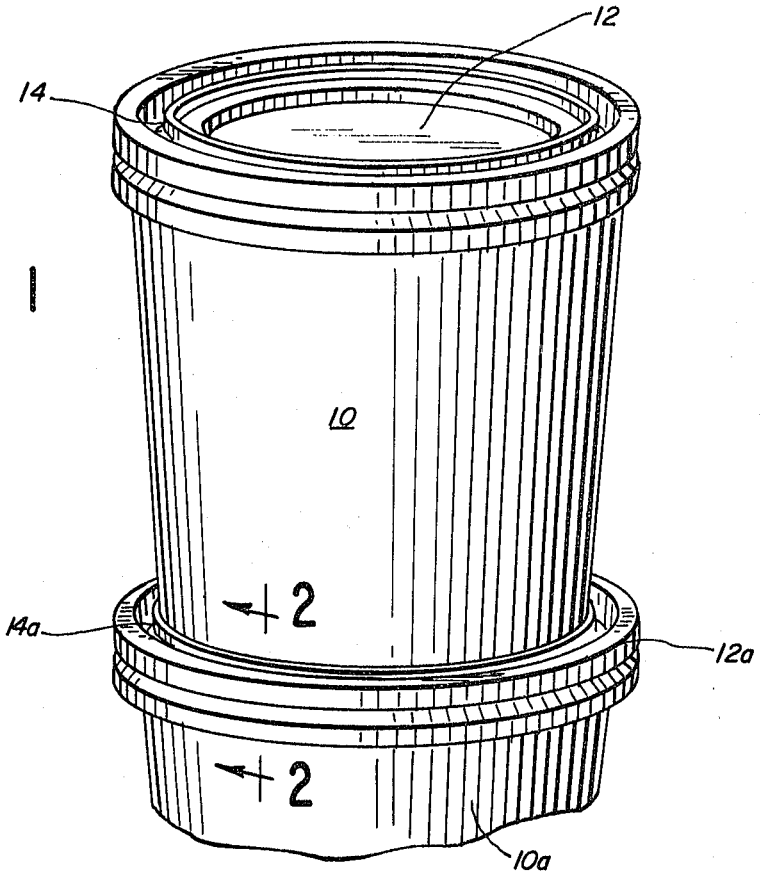
FIG. 1 is a perspective view of a bucket in accordance with this invention, being shown as part of a stack of said buckets.

Referring to the drawings, bucket 10 carries a lid 12, both being made out of a plastic such as polyethylene or a copolymer thereof, and being stacked on top of an identical bucket 10*a* which also carries a lid 12*a* which, in turn, carries the weight of the bucket 10. As shown, lids 12, 12*a* respectively carry an outer ring 14, 14*a* on the upper surfaces thereof, which rings serve to center and position the bottom of a tapered bucket stacked above it, to assure that the weight of the upper bucket 10 can be transmitted to the annular shelf of the bucket underneath.

Figure 2:
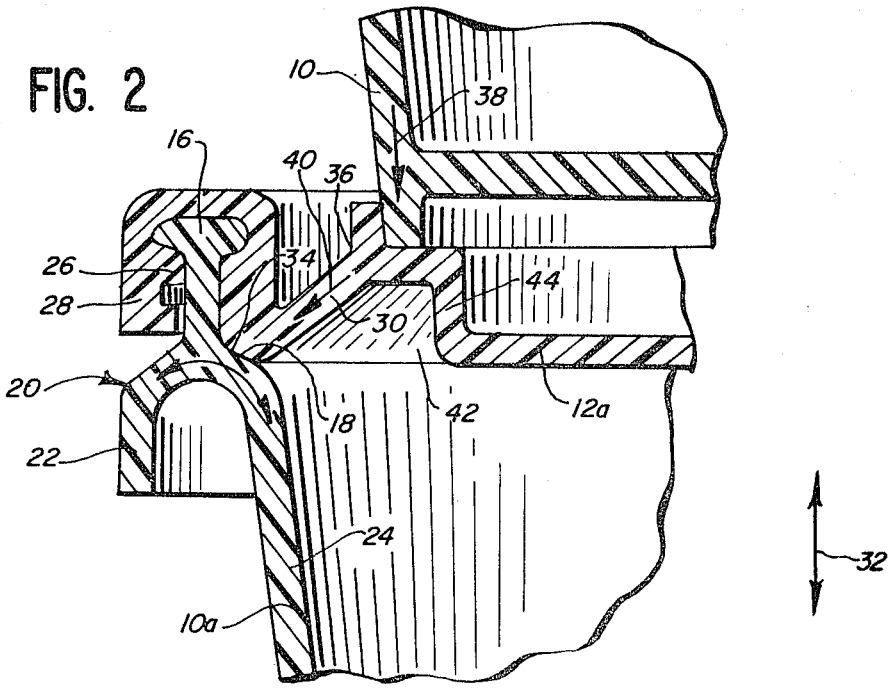
FIG. 2 is a sectional view taken along line 2—2 of FIG. 1.

As shown in FIG. 2, bucket 10*a* (and also bucket 10) defines an enlarged annular projection 16 at the mouth thereof, and an inwardly positioned, annular shelf 18 facing the mouth of the bucket adjacent lip 16. Outwardly positioned annular flange 20 is joined to the bucket adjacent annular shelf 18, to provide extra hoop strength to the area of annular shelf 18. Annular flange 20 can be seen to be curved in cross section to define a flange section 22 which is in longitudinal relation to the wall 24 of bucket 10 or 10*a*.

Buckets 10, 10*a* and lids 12, 12*a* can be molded by conventional techniques out of polyolefin plastic or the like.

As shown in FIG. 2, lid 12*a*, which is identical in design to lid 12, is attached to lip 16 with the lid defining in one piece a peripheral, annular recess 26 which receives and holds lip 16 in locking relation. Outer flange 28 of lid 12*a* may be pried outwardly by a screwdriver or the like to release the locking relation of annular recess 26 and lip 16, with lids 12, 12*a* being sealable off of the annular lip 16 of the buckets 10, 10*a*. For closing the bucket, lip 16 can simply be snapped into recess 26 by appropriate pounding or other pressure.

Lids 12, 12*a* also define annular straight wall 30 which extends radially inwardly from recess 26 in an angle of essentially 20° to 60° from axis 32 of the bucket, the annular, straight wall 30 being positioned with its outer edge 34 being adjacent annular recess 26, and being particularly positioned to abut against annular shelf 18 in force-transmitting relation. The inner edge 36 of annular straight wall extends outwardly toward the bucket mouth relative to outer edge 34, so that force from the weight of the upper stacked bucket 10, as shown by vector 38, can be transmitted as shown in vector 40 through annular straight wall to annular shelf 18.

As the result of this, the bucket and lid system of this invention exhibits improved stacking strength, and is able to withstand greater loads on lids 12, 12*a* than comparable plastic buckets of other known designs.

If desired, a series of radial ribs 42 may be provided to further strengthen annular straight wall 30, and prevent it from deflecting. These optional radial ribs may be connected as an integral part of the underside of annular wall 30 and communicate with inner annular wall 44 as an integral part of lids 12, 12*a*. While ribs 42 are optional, typically from three to twenty-four of such ribs may be used, depending upon the particular strength that may be desired. Ribs 42 may be an integral molded part of each lid 12, 12*a*.

The bucket of this invention exhibits the advantage that it appears to be a conventional bucket, and thus is a familiar looking item to the trade, despite the novel structure incorporated herein. For example, ribs 42 are invisible until the bucket is opened, and annular straight wall 30 is not particularly noticeable unless the bucket is carefully inspected.

The above has been offered for illustrative purposes only, and is not intended to limit the scope of the invention of this application, which is as defined in the claims below.

That which is claimed is:

1. A molded bucket, which comprises:

a bucket lip defining an enlarged, annular projection at the mouth of said bucket;

an inwardly positioned, annular shelf facing said mouth adjacent said lip; and an outwardly positioned annular flange joined to said bucket adjacent said annular shelf, to provide extra hoop strength to the area of said annular shelf, said annular flange having a portion lying in spaced, longitudinal relationship to the bucket sidewall.

2. A molded bucket, which comprises:

a bucket lip defining an enlarged, annular projection at the mouth of said bucket;

an inwardly positioned, annular shelf facing said mouth adjacent said lip;

an outwardly positioned annular flange joined to said bucket adjacent said annular shelf, to provide extra hoop strength to the area of said annular shelf, said annular flange is curved in cross section to define a flange section which is in longitudinal relation to the bucket wall.

3. A molded bucket, which comprises:

a bucket lip defining an enlarged, annular projection at the mouth of said bucket;

an inwardly positioned, annular self facing said mouth adjacent said lip;

an outwardly positioned annular flange joined to said bucket adjacent said annular shelf, to provide extra hoop strength to the area of said annular shelf, which carries a lid attached to said lip, said lid defining in one piece a peripheral, annular recess receiving said annular projection in locking relation, and an annular, straight wall which extends radially inwardly from the vicinity of said recess at an angle of essentially 20° to 60° from the axis of said bucket, said annular straight wall being positioned with its outer edge adjacent said annular recess and abutting said annular shelf, and its inner edge extending outwardly toward said mouth relative to the outer edge, whereby said bucket and lid exhibit high stacking strength, an annular, upstanding flange is provided on the outer side of said lid at the inner edge of said annular recess.

4. The molded bucket of claim 3 which is a tapered bucket, the bottom of said bucket having a diameter of no more than the diameter of the inner edge of the annular straight wall.

5. The molded bucket of claim 3 in which radial waves are provided to stiffen said annular, straight wall.

6. A molded bucket, which comprises:

a bucket lip defining an enlarged, annular projection at the mouth of said bucket;

an inwardly positioned, annular self facing the mouth adjacent said lip;

an outwardly positioned annular flange joined to said bucket adjacent said annular shelf, to provide extra hoop strength to the area of said annular shelf, said bucket being a tapered bucket and carrying a lid attached to said lip, said lip defining in one piece a peripheral, annular recess receiving said annular projection in locking relation, and an annular straight wall which extends radially outwardly at an angle of essentially 20° to 60° from the axis of said bucket, said annular straight wall being positioned with its outer edge adjacent said annular recess and abutting said annular shelf, and its inner edge extending outwardly toward said mouth relative to the outer edge, whereby said bucket and lid exhibit high stacking strength, the bottom of said tapered bucket having a diameter of no more than the diameter of the inner edge of the annular straight wall.

7. The molded bucket of claim 6 in which radial vanes are provided to stiffen said annular straight wall.

8. The molded bucket of claim 7 in which an annular, upstanding flange is provided on the outer side of said lid radially inward of said annular recess, said flange being of a diameter sufficient to snugly receive the bottom end of an identical tapered bucket.

9. The molded bucket of claim 8 in which said annular flange is curved in cross section to define a flange section which is in longitudinal relation to the bucket wall.

* * * * *